US005792259A

United States Patent [19]

Yoshioka et al.

[11] Patent Number: 5,792,259

[45] Date of Patent: Aug. 11, 1998

[54] SUBSTRATE PROCESSING APPARATUS AND AIR SUPPLY METHOD IN SUBSTRATE PROCESSING APPARATUS

[75] Inventors: Katsushi Yoshioka; Yoshiteru Fukutomi; Kenji Sugimoto, all of Kyoto, Japan

[73] Assignee: Dainippon Screen Mfg. Co., Ltd., Kyoto, Japan

[21] Appl. No.: 749,348

[22] Filed: Nov. 21, 1996

[30] Foreign Application Priority Data

Nov. 27, 1995 [JP] Japan ..... 7-307318

[51] Int. Cl.[6] ..... B05C 5/00

[52] U.S. Cl. ..... 118/52; 118/56; 118/62; 118/63; 118/319; 118/320; 118/326; 427/240

[58] Field of Search ..... 118/52, 56, 319, 118/320, 326, 62, 63; 34/487, 218, 231–233; 454/187; 427/240; 134/902

[56] References Cited

U.S. PATENT DOCUMENTS

| | | | |
|---|---|---|---|
| 3,380,369 | 4/1968 | Allander | 454/187 |
| 3,776,121 | 12/1973 | Truhan | 454/187 |
| 4,510,176 | 4/1985 | Cuthbert et al. | 427/240 |
| 4,616,594 | 10/1986 | Itho | 118/326 |
| 5,116,250 | 5/1992 | Sago et al. | 427/240 |
| 5,472,502 | 12/1995 | Batchelder | 118/63 |
| 5,565,034 | 10/1996 | Nanba et al. | 118/52 |
| 5,634,975 | 6/1997 | Josefsson | 118/326 |

*Primary Examiner*—Laura Edwards
*Attorney, Agent, or Firm*—Ostrolenk, Faber, Gerb, & Soffen, LLP

[57] ABSTRACT

A velocity adjusting plate is provided above a substrate processing part in the interior of a substrate processing apparatus which is isolated from the external air. Thus, a downflow which is formed by conditioned air in the interior of the apparatus is separated into downflows having high and low velocities to be supplied to the substrate processing part and the periphery of the substrate processing part respectively. Consequently, the former downflow has a velocity which is suitable for controlling the temperature-humidity on the substrate surface and preventing the substrate from adhesion of particles and fine grains of a processing solution scattered from the substrate, while the latter downflow is suppressed to the minimum velocity which is necessary for preventing dusts and particles from creeping up by dispersion. Thus, it is possible to reduce consumption of air which is adjusted in temperature-humidity while isolating the interior of the apparatus from the external air.

13 Claims, 6 Drawing Sheets

SUBSTRATE PROCESSING APPARATUS AND AIR SUPPLY METHOD IN SUBSTRATE PROCESSING APPARATUS

BACKGROUND OF THE INVENTION

1. Field of the Invention

The present invention relates to a substrate processing apparatus which is supplied with air in its interior for processing a substrate and an air supply method in this substrate processing apparatus.

2. Description of the Background Art

Some Substrate processing apparatuses for processing substrates such as semiconductor substrates and glass substrates supply substrate processing parts with conditioned downflows which are formed by air (hereinafter referred to as conditioned air) adjusted in various elements such as temperature-humidity and cleanliness, in order to control temperature-humidity in the vicinity of substrate surfaces and prevent the substrates from adhesion of particles and fine grains of processing solutions scattered from the substrates. Particularly in a substrate processing apparatus for supplying a substrate with a processing solution such as a resist solution or a developing solution, the applied state of the processing solution is remarkably influenced by the temperature and humidity around the substrate surface, and hence supply of conditioned air is indispensable.

FIG. 1 illustrates an exemplary conventional substrate processing apparatus. In this apparatus, an air supply part (not shown) for generating conditioned air is connected to a box 121 which is arranged on a position directly above a substrate processing part 101, so that the conditioned air generated in the air supply part is supplied into the box 121 through an air supply pipe 130. The conditioned air supplied into the box 121 passes through a filter 131 provided on the lower surface of the box 121 and forms a conditioned downflow 161, which flows into the substrate processing part 101. The box 121 is so sized as to cover only the substrate processing part 101, whereby the conditioned downflow 161 formed by the conditioned air flows into only the substrate processing part 101. In this substrate processing apparatus, a unit cover 120 is provided to enclose the substrate processing part 101, and a clean room downflow 170 is supplied to the overall substrate processing apparatus from above, in order to prevent dusts and particles from creeping up by diffusion. This clean room downflow 170 is supplied in the overall clean room which is provided with the substrate processing apparatus.

FIG. 2 illustrates another exemplary conventional substrate processing apparatus. In this apparatus, an air supply part (not shown) for generating conditioned air is connected to an upper portion of a unit cover covering upper and side portions of a substrate processing part 201, so that the conditioned air from the air supply part is supplied into a box 221 which is a part of the unit cover through an air supply pipe 230. The conditioned air supplied into the box 221 passes through a filter 231 provided on the lower surface of the box 221 and forms a conditioned downflow 261, which is supplied into a cover 220 forming the unit cover to flow into the substrate processing part 201. According to this apparatus, the unit cover consisting of the box 221 and the cover 220 encloses the upper and side portions of the substrate processing part 201, whereby the conditioned downflow 261 is substantially homogeneously generated all over the interior of the apparatus while being completely isolated from the external air.

In the substrate processing apparatus shown in FIG. 1, the consumption of the conditioned air may be minimized since the conditioned downflow 161 is supplied only to the substrate processing part 101. However, no means is provided for isolating the conditioned downflow 161 from the clean room downflow 170, and hence the clean room downflow 170 which is not adjusted in temperature-humidity etc. and inferior in cleanliness disadvantageously flows into the substrate processing part 101. Thus, it is difficult to control the temperature-humidity of the substrate and prevent the substrate from adhesion of particles etc. Further, it is necessary to set the box 121 on the position directly above and close to the substrate processing part 101 in order to supply the conditioned downflow 161 only to the substrate processing part 101, and hence maintenance of the substrate processing part 101 is hard to execute.

In the substrate processing apparatus shown in FIG. 2, on the other hand, the conditioned downflow 261 is completely isolated from the environment which is fed with the clean room downflow 270 by the unit cover consisting of the box 221 and the cover 220, whereby the clean room downflow 270 can be completely prevented from flowing into the substrate processing part 201. Therefore, it is possible to process the substrate in substrate processing environment which is excellent in temperature-humidity control for the substrate and prevention of the substrate from adhesion of particles. Further, a sufficient space can be provided above the substrate processing part 201, leading to easy maintenance. In the apparatus shown in FIG. 2 generating the conditioned downflow 261 by the conditioned air in the overall region of the unit cover, however, the conditioned downflow 261 of a high velocity must be unnecessarily supplied also to the region other than the substrate processing part 201 in the unit cover. Thus, the consumption of the conditioned air is disadvantageously increased, to inevitably increase the size of the overall system and the running cost.

In consideration of the aforementioned problems, an object of the present invention is to provide a substrate processing apparatus which can minimize the overall system and reduce the running cost by completely isolating a substrate processing part for performing a prescribed processing on a substrate from the exterior of the apparatus for maintaining excellent substrate processing environment while reducing consumption of conditioned air.

SUMMARY OF THE INVENTION

The present invention is directed to a substrate processing apparatus involving generation of a downflow in its interior.

According to the present invention, the substrate processing apparatus comprises a substrate processing part for performing a prescribed processing on a substrate; a unit cover enclosing upper and side portions of the substrate processing part; air supply means for supplying conditioned air from the exterior of an upper portion of the unit cover toward the interior thereby generating a conditioned downflow in the interior of the unit cover; and velocity adjusting means which is provided above the substrate processing part in the interior of the unit cover for adjusting the conditioned downflow so that the velocity of a part flowing into the substrate processing part is higher than that of a part flowing into another region.

The inventive apparatus is applied to an apparatus involving application of a processing solution to the substrate, for example.

As a preferred mode of the velocity adjusting means in the inventive apparatus, conceivable is such a plate type member that a rate of hole area in a region directly above the substrate processing part is higher than that in a region other than the region directly above the substrate processing part.

The present invention also provides a method of supplying conditioned air into the interior of the substrate processing apparatus.

Accordingly, an object of the present invention is to reduce consumption of conditioned air while maintaining excellent substrate processing environment. Thus, it is possible to attain miniaturization of the overall system and reduction of the running cost.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
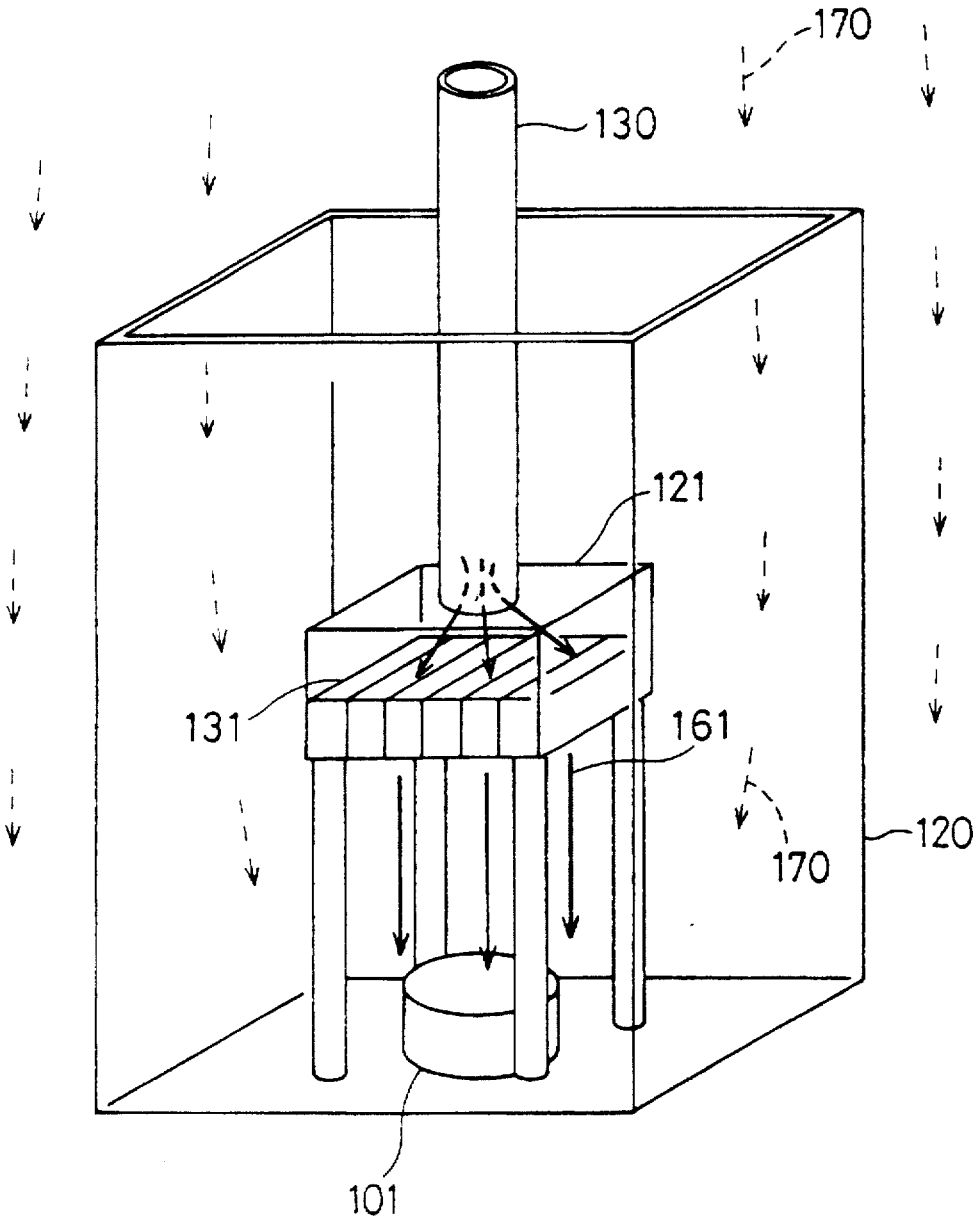
FIG. 1 (PRIOR ART)
FIG. 1 is a perspective view showing an exemplary conventional substrate processing apparatus.
Figure 2:
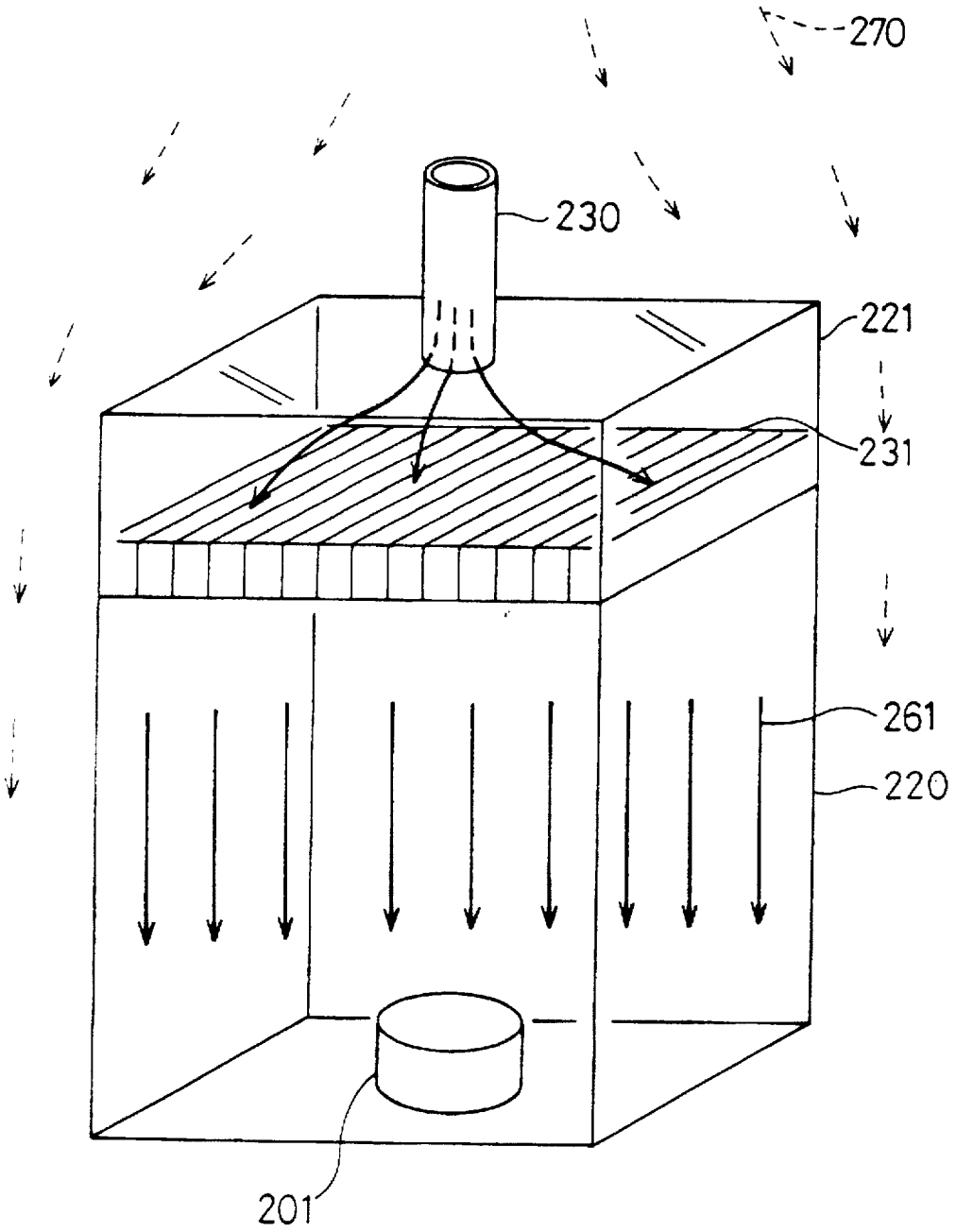
FIG. 2 (PRIOR ART)
FIG. 2 is a perspective view showing another exemplary conventional substrate processing apparatus.
Figure 3:
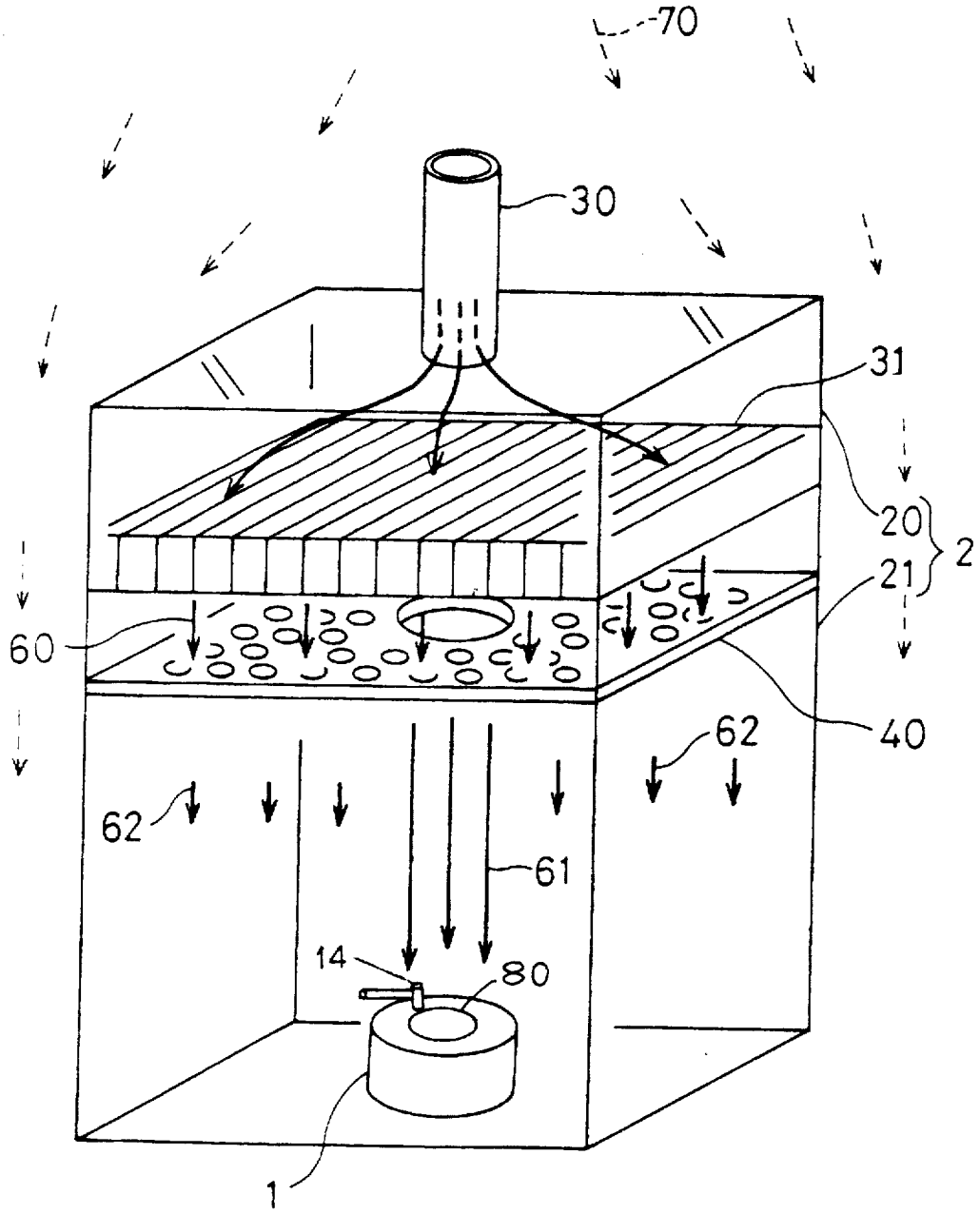
FIG. 3 is a perspective view showing a substrate processing apparatus according to a preferred embodiment of the present invention.
Figure 4:
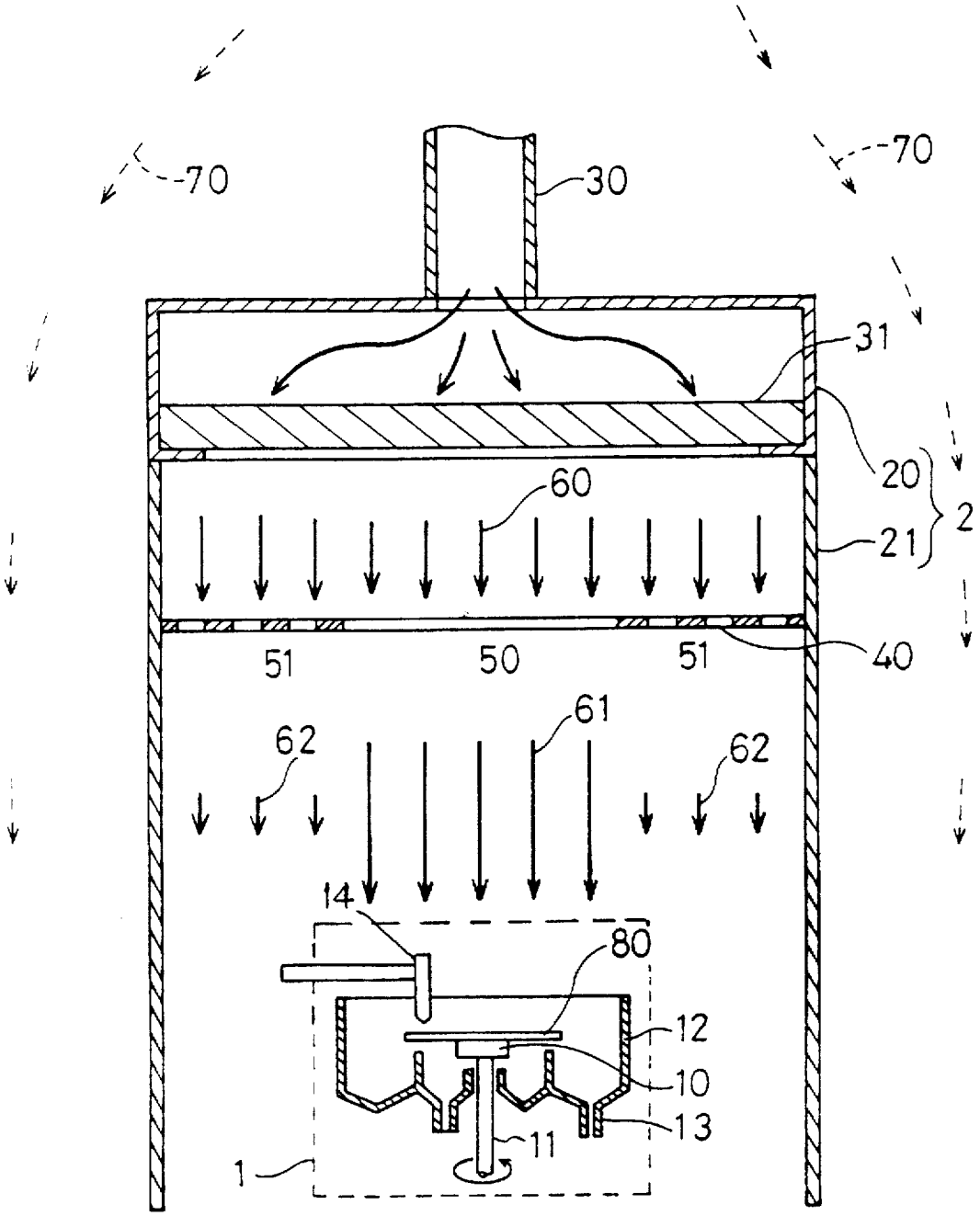
FIG. 4 is a sectional view of the substrate processing apparatus shown in FIG. 3.

FIG. 3 is a perspective view showing a substrate processing apparatus according to a preferred embodiment of the present invention, and FIG. 4 is a sectional view of the substrate processing apparatus shown in FIG. 3. A substrate 80 shown in FIG. 4 is placed on a substrate support part 10, which is connected to rotation driving means (not shown) through a shaft 11. A nozzle 14 is provided on a position above the substrate 80, so that a processing solution such as a resist solution is supplied from this nozzle 14 to the substrate surface, while the substrate support part 10 is rotated by the rotation driving means for rotating the substrate 80 and executing a prescribed substrate processing. Peripheral side portions of the substrate 80 are enclosed with a cup 12, so that the processing solution scattered around the substrate 80 in the processing is collected in the cup 12 and discharged to the exterior through a discharge pipe 13 which is connected to a lower portion of the cup 12. Thus, a substrate processing part 1 is formed by the substrate support part 10, the shaft 11 and the cup 12 in this embodiment.

Upper and side portions of the substrate processing part 1 are enclosed with a unit cover 2 which is formed by a box 20 and a cover 21. An end of an air supply pipe 30 is connected to an upper portion of the box 20, while the other end of the air supply pipe 30 is connected to an air supply part (not shown). Further, a filter 31 is provided on a lower portion of the box 20. Therefore, conditioned air supplied from the air supply part passes through the box 20 and the filter 31 and flows into the cover 21 as a conditioned downflow 60. The interior of the apparatus is isolated from the exterior due to the presence of the unit cover 2, whereby a clean room downflow 70 which is not adjusted to desired temperature-humidity and cleanliness is completely prevented from flowing into the unit cover 2, so that only air which is set at desired temperature-humidity and cleanliness is present in the unit cover 2.

Figure 5:
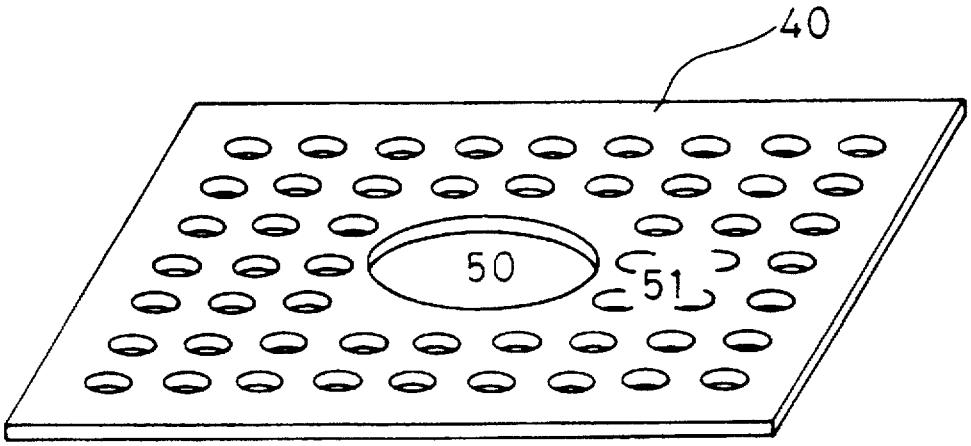
FIG. 5 is a perspective view showing a shape of a velocity adjusting plate.

Further, a velocity adjusting plate 40 is provided above the substrate processing part 1 in the interior of the cover 21, to serve as velocity adjusting means. FIG. 5 is a perspective view of the velocity adjusting plate 40, which consists of a large opening part 50 largely opening above the substrate processing part 1 and a small opening part 51 provided with a number of small-diametral through holes.

The operation of the substrate processing apparatus having the structure shown in FIGS. 3 and 4 is now described. In this substrate processing apparatus, the air supply part is operated in advance of the substrate processing in the substrate processing part 1, for supplying conditioned air into the box 20 through the air supply pipe 30. Thus, the conditioned air passing through the filter 31 forms the conditioned downflow 60 between the filter 31 and the velocity adjusting plate 40.

The conditioned downflow 60 flowing into the velocity adjusting plate 40 is separated into conditioned downflows 61 and 62 passing through the large and small opening parts 50 and 51 of the velocity adjusting plate 40 respectively, so that the conditioned downflow 61 flows into the substrate processing part 1. This conditioned downflow 61 flowing into the substrate processing part 1 functions to control the temperature-humidity on the substrate surface and prevent the substrate from adhesion of particles and fine grains of the processing solution scattered from the substrate. The large opening part 50 is larger in opening area per unit area than the small opening part 51 such that resistance against the conditioned air passing through the large opening part 50 is smaller than that through the small opening part 51, whereby the conditioned downflow 61 is higher in velocity than the conditioned downflow 62. Therefore, the conditioned downflow 61 flowing into the substrate processing part 1 is at a velocity which is necessary for controlling the temperature-humidity of the substrate surface and preventing the substrate from adhesion of particles and fine grains of the processing solution scattered from the substrate, while the conditioned downflow 62 flowing into the remaining region can be suppressed to the minimum velocity necessary for preventing dusts and particles from creeping up. It has been recognized possible to attain an effect of suppressing disturbance of the conditioned downflows 61 and 62 by providing a space between the filter 31 and the velocity adjusting plate 40 in this case.

According to the substrate processing apparatus of this embodiment, as hereinabove described, the overall substrate processing part 1 is enclosed with the unit cover 2 consisting of the box 20 and the cover 21 so that the interior of the apparatus is completely isolated from the exterior, whereby the clean room downflow 70 can be prevented from flowing into the substrate processing part 1. Thus, the substrate processing part 1 can be regularly maintained under substrate processing environment with air which is set at desired temperature-humidity and cleanliness.

Further, the overall substrate processing part 1 is enclosed with the unit cover 2, whereby a sufficient space can be provided above the substrate processing part 1 so that the substrate processing part 1 is easy to maintain.

In addition, the velocity adjusting plate 40 is provided above the substrate processing part 1 in the interior of the unit cover 2 for supplying the substrate processing part 1 and the remaining part with the conditioned downflows 61 and 62 which are at relatively high and low velocities respectively, whereby the consumption of the conditioned air can be reduced for attaining miniaturization of the overall system and reduction of the running cost.

Figure 6:
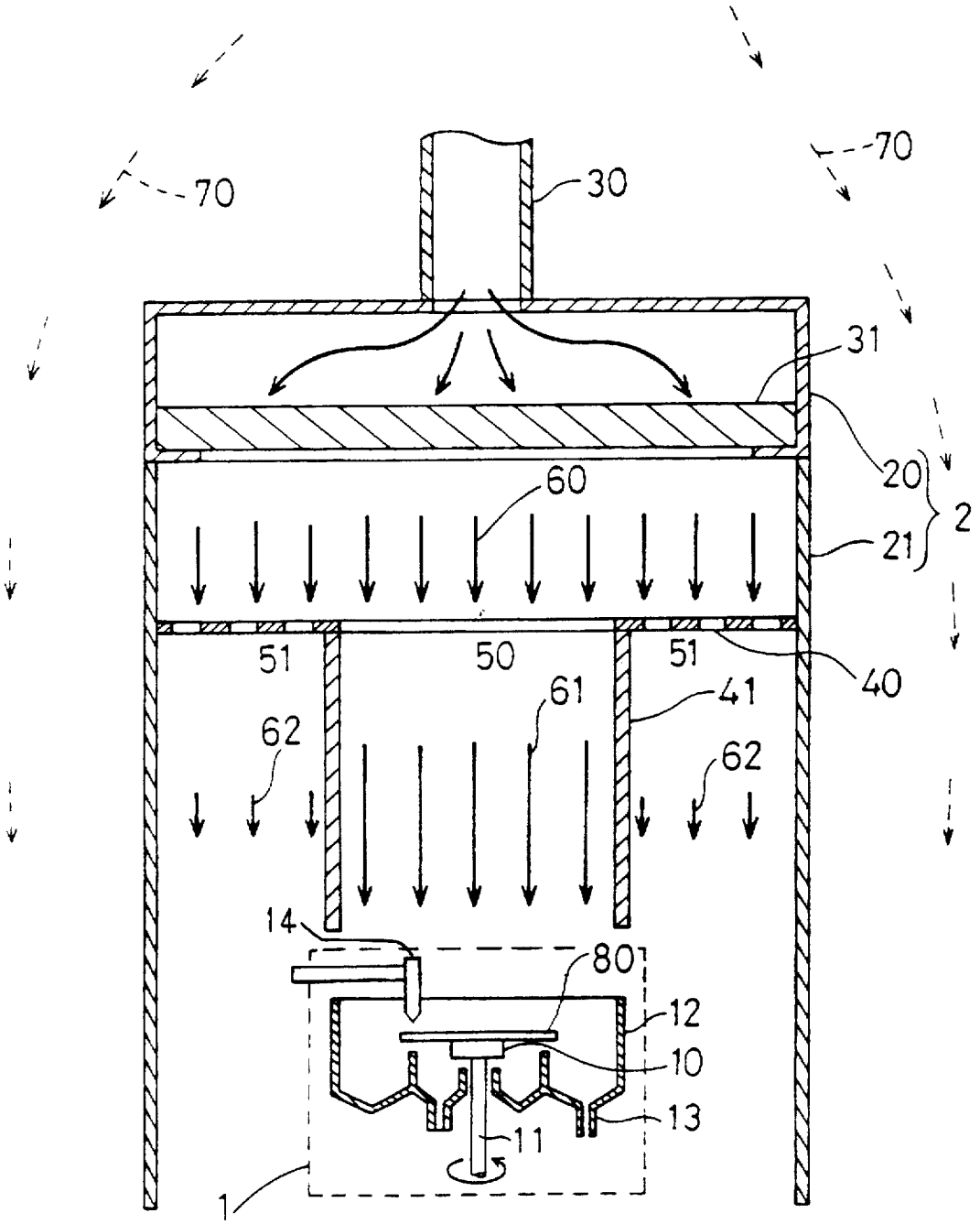
FIG. 6 is a sectional view showing a substrate processing apparatus according to another preferred embodiment of the present invention.

While the embodiment shown in FIG. 3 has been described, the present invention is not restricted to the aforementioned embodiment. As shown in FIG. 6, for example, means which is prepared by adding a detachable cylindrical guide tube 41 to a lower portion of the large opening part 50 of the velocity adjusting part 40 may be employed as the velocity adjusting means in the substrate processing apparatus having the structure of FIG. 3. Due to such addition of the guide tube 41, the conditioned downflow 61 passing through the large opening part 50 can effectively and reliably reach the substrate 80 without being weakened.

While the invention has been shown and described in detail, the foregoing description is in all aspects illustrative and not restrictive. It is therefore understood that numerous modifications and variations can be devised without departing from the scope of the invention.

What is claimed is:

1. A substrate processing apparatus for processing a substrate, said apparatus comprising:

(a) a substrate processing part for processing said substrate;

(b) a unit cover enclosing upper and side portions of said substrate processing part;

(c) air supply means for supplying conditioned air from the exterior of an upper portion of said unit cover toward the interior of said upper portion thereby generating a conditioned downflow in the interior of said unit cover; and (d) velocity adjusting means being provided above said substrate processing part in the interior of said unit cover, said velocity adjusting means adjusting said conditioned downflow so that a first part of said conditioned downflow flowing substantially into the region of said substrate processing part is higher in velocity than a second part of said conditioned downflow flowing substantially into the remaining region.

2. The substrate processing apparatus in accordance with claim 1, wherein said substrate processing part is provided with:

(a-1) application means for applying a processing solution to said substrate.

3. The substrate processing apparatus in accordance with claim 1, wherein said velocity adjusting means comprises:

(d-1) a first region located directly above said substrate processing part, said first region having a first fluid resistance; and (d-2) a second region other than said first region, said second region having a second fluid resistance, said second fluid resistance being greater than said first fluid resistance.

4. The substrate processing apparatus in accordance with claim 3, wherein said velocity adjusting means further comprises a plate in which a number of through holes are formed, said first and second regions being regions of said plate, a ratio of hole area to plate area of said first region being greater than that of said second region.

5. The substrate processing apparatus in accordance with claim 3, wherein said velocity adjusting means further comprises:

(d-3) a tubular body extending from said first region toward said substrate processing part.

6. A method of supplying air into the interior of a substrate processing apparatus having a substrate processing part, comprising the steps of:

(a) supplying conditioned air from above said substrate processing apparatus toward the interior of said substrate processing apparatus for generating a conditioned downflow in the interior of said substrate processing apparatus;

(b) generating a first conditioned downflow of a first velocity and a second conditioned downflow of a second velocity, said first velocity being higher than said second velocity; and (c) guiding said first conditioned downflow substantially toward a first region of the interior of said substrate processing apparatus, said first region including said substrate processing part, and guiding said second conditioned downflow substantially toward a second region of the interior of said substrate processing apparatus, said second region not including said substrate processing part.

7. The substrate processing apparatus in accordance with claim 3, wherein said first region comprises a large diameter passage, and said second region comprises a plurality of small diameter passages comprising through holes.

8. A substrate processing apparatus for processing a substrate, comprising:

(a) a substrate processing part for performing a prescribed processing on said substrate;

(b) a unit cover enclosing upper and side portions of said substrate processing part;

(c) an air supply supplying conditioned air from the exterior of an upper portion of said unit cover toward the interior of said upper portion thereby generating a conditioned downflow in the interior of said unit cover; and (d) a velocity adjuster provided above said substrate processing part in the interior of said unit cover, said velocity adjuster adjusting said conditioned downflow so that a first part of said conditioned downflow flowing substantially into said substrate processing part is higher in velocity than a second part of said conditioned downflow not flowing substantially into said substrate processing part.

9. The substrate processing apparatus in accordance with claim 8, wherein said substrate processing part is provided with:

(a-1) an applicator applying a processing solution to said substrate.

10. The substrate processing apparatus in accordance with claim 8, wherein said velocity adjuster comprises:

(d-1) a first region located directly above said substrate processing part, said first region having a first fluid resistance; and (d-2) a second region other than said first region, said second region having a second fluid resistance, said second fluid resistance being greater than said first fluid resistance.

11. The substrate processing apparatus in accordance with claim 10, wherein said velocity adjuster further comprises a plate in which a number of through holes are formed, said first and second regions being regions of said plate, a ratio of hole area to plate area of said first region being greater than that of said second region.

12. The substrate processing apparatus in accordance with claim 10, wherein said velocity adjuster further comprises:

(d-3) a tubular body extending from said first region toward said substrate processing part.

13. The substrate processing apparatus in accordance with claim 10, wherein said first region comprises a large diameter passage and said second region a plurality of small diameter passages comprising through holes.

* * * * *